United States Patent [19]

Buck

[11] 3,937,408

[45] Feb. 10, 1976

[54] BLADE ARRANGEMENT FOR A MEAT CUTTER

[76] Inventor: Immanuel Buck, Flurstrasse 15, 7012 Fellbach, Germany

[22] Filed: Nov. 29, 1974

[21] Appl. No.: 528,449

[30] Foreign Application Priority Data

| | | |
|---|---|---|
| Nov. 29, 1973 | Germany | 2359539 |
| July 25, 1975 | Germany | 2435796 |
| Oct. 23, 1974 | Germany | 2450421 |

[52] U.S. Cl. ..... 241/282.2; 83/664; 241/292.1

[51] Int. Cl.[2] ..... B02C 18/18

[58] Field of Search ..... 241/282.2, 292.1, 282.1; 83/664, 665

[56] References Cited

UNITED STATES PATENTS

| | | | |
|---|---|---|---|
| 3,030,993 | 4/1962 | Schmook, Jr. | 241/282.2 |
| 3,303,317 | 7/1967 | Schaller | 241/282.2 |
| 3,631,907 | 1/1972 | Laska | 241/292.1 |
| 3,730,363 | 5/1973 | Karpf | 241/292.1 |

*Primary Examiner*—Frank T. Yost
*Attorney, Agent, or Firm*—Edwin E. Greigg

[57] ABSTRACT

The blade arrangement for meat cutters is such that the blades are mounted on a shaft in a form-locking manner and extensive continuous adjustment of the blades is possible while the blades remain firmly supported. With this arrangement the structure which secures the blades can bear extremely large forces at high shaft revolutions. The arrangement includes a driven shaft on which form-locking disks are mounted and between which a blade group is disposed. The blades of the blade group include a flange head which are guided in a radial direction on fixed guide surfaces on at least one of the disks. The flange heads of each blade of at least one blade group have one or more outer edges and one or more straight edge regions forming an opening. A guide bar is provided for the outer edges and a pin is provided for each opening.

17 Claims, 10 Drawing Figures

Fig. 1
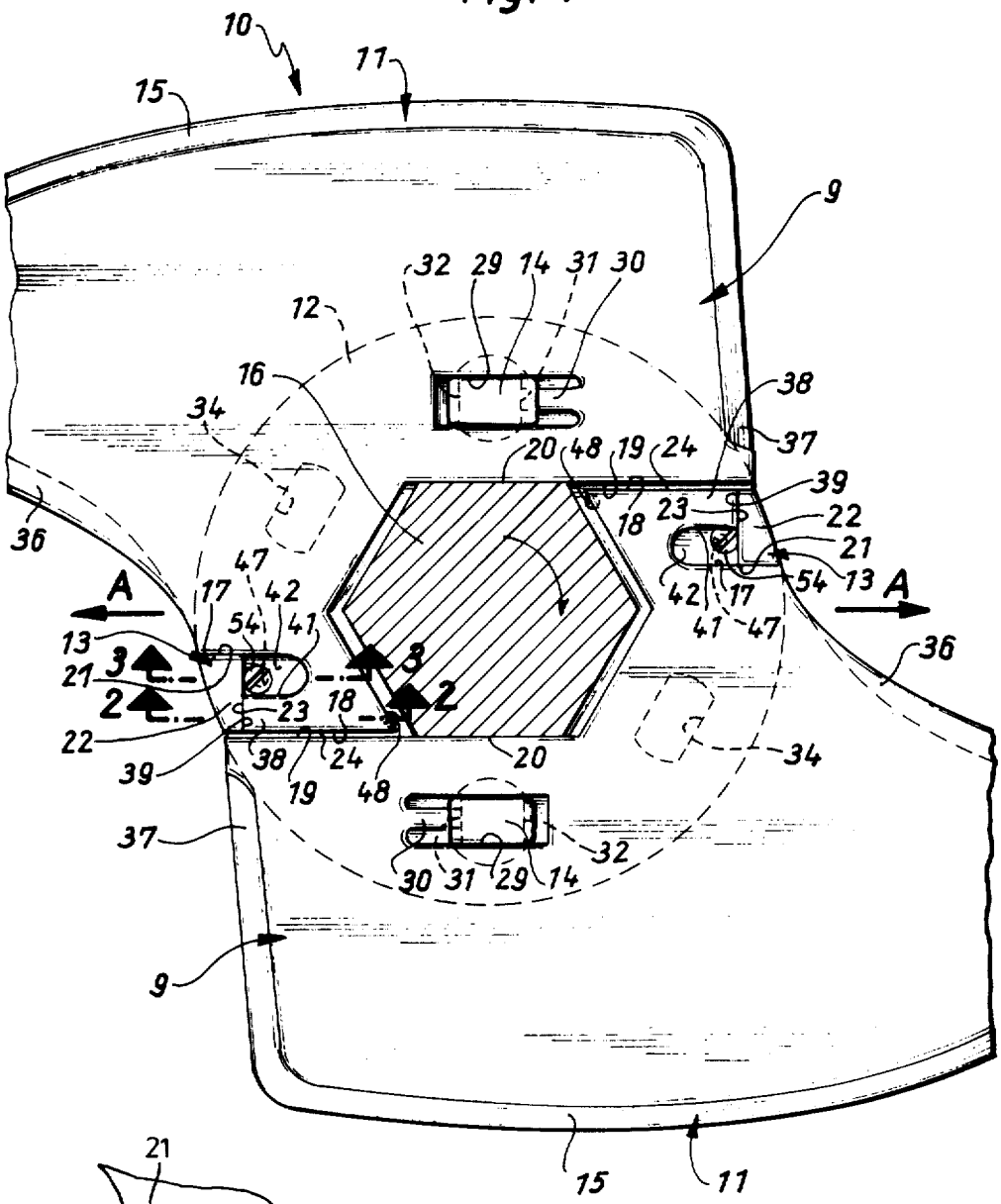
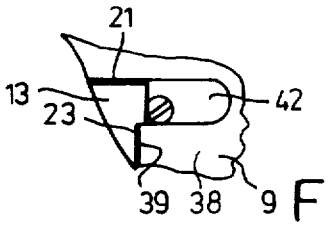
FIG. 4

BLADE ARRANGEMENT FOR A MEAT CUTTER

BACKGROUND OF THE INVENTION

The present invention relates to a blade arrangement for a meat cutter comprising a driven shaft on which disks are disposed adjacent to each other in a form-locking manner and wherein a blade group, preferably comprising two identical blades, is disposed between each pair of adjacent disks and the disks are braced together in the axial direction of the shaft, the flange head of each blade being guided in a radial direction on rigid guide surfaces of at least one of the adjacent disks.

With blade arrangements of this type, preferably two and possibly more identical blades are disposed in a common plane between two disks in such a way that this group of blades is balanced with respect to the axis of rotation of the shaft and at least two groups of blades are provided. During operation the blades are subject to extremely high stresses which increase as the r.p.m. of the blade shaft increases. Modern meat cutters frequently operate with rates of revolution in excess of 6,000 r.p.m. The maximum cutting radii of the blade arrangement can be very extensive, for example, 320 mm. These values are obviously only provided by way of example.

The blades were previously screwed onto the disks and a straight groove was formed by milling in the front side of the disk for guide purposes. As the effective guide length of the groove guiding the flange head of a blade is reduced during grinding as a result of the necessary displacement of the flange head, the support for the blade in the groove deteriorates, thereby restricting adjustment possibilities. It has also been found that as a result of the extremely powerful stresses acting on the flange heads during operation they tore very easily as they were generally considerably weakened by the three longitudinal slits for the securing screws.

OBJECTS AND SUMMARY OF THE INVENTION

Accordingly, it is a principal object of the invention to provide an improved blade arrangement which permits relatively extensive continuous adjustment of the blades while they remain firmly supported and wherein the blade securing means can bear extremely large forces at high shaft revolutions.

To achieve this object a blade arrangement of the type described initially is designed in such a way that the edges of the flange head of each blade in at least one group of blades which are guided by the guide faces constitute one or more outer edges of the flange head and one or more straight edge regions of at least one opening in the flange head and that the guide means for the outer edge or edges in the flange head are formed by a least one bar projecting beyond an adjacent disk and the guide means for the straight edge region or regions of the opening are formed by at least one pin which engages in the opening.

Other objects, features and advantages of the present invention will be made apparent from the following detailed description of preferred embodiments thereof provided with reference to the accompanying drawings.

BRIEF DESCRIPTION OF THE DRAWINGS

FIG. 1 is a plan view of a blade group consisting of two blades, the blades of which are guided on a disk disposed in a form-locking manner in accordance with a first embodiment.

FIG. 4 is a variant of the section shown in FIG. 1.

In the drawings, identical parts bear identical reference numbers.

DESCRIPTION OF THE PREFERRED EMBODIMENTS

Figure 5:
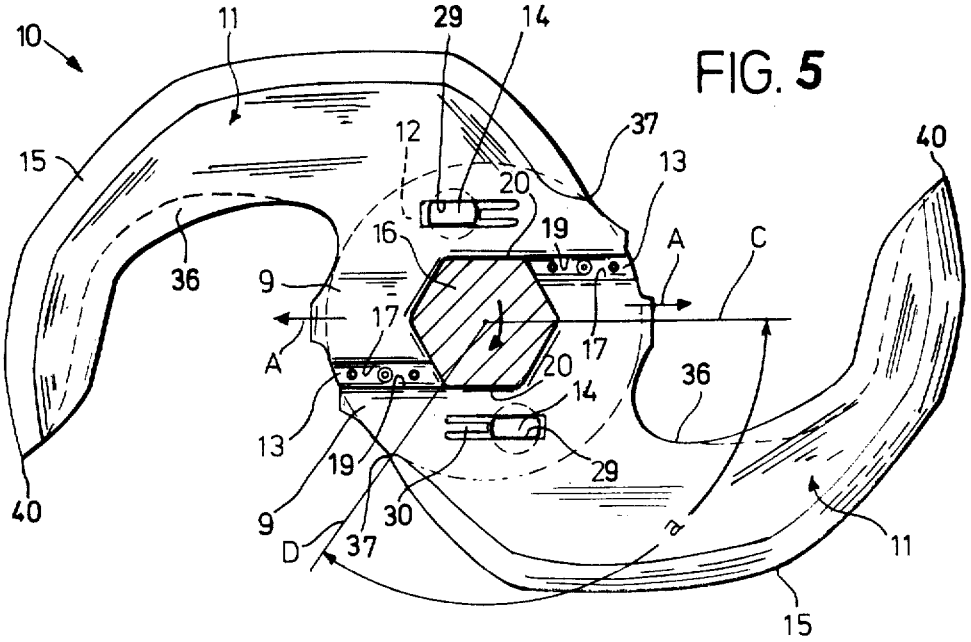
FIG. 5 is a plan view according to FIG. 1, but of a third embodiment and on a reduced scale.
Figure 6:
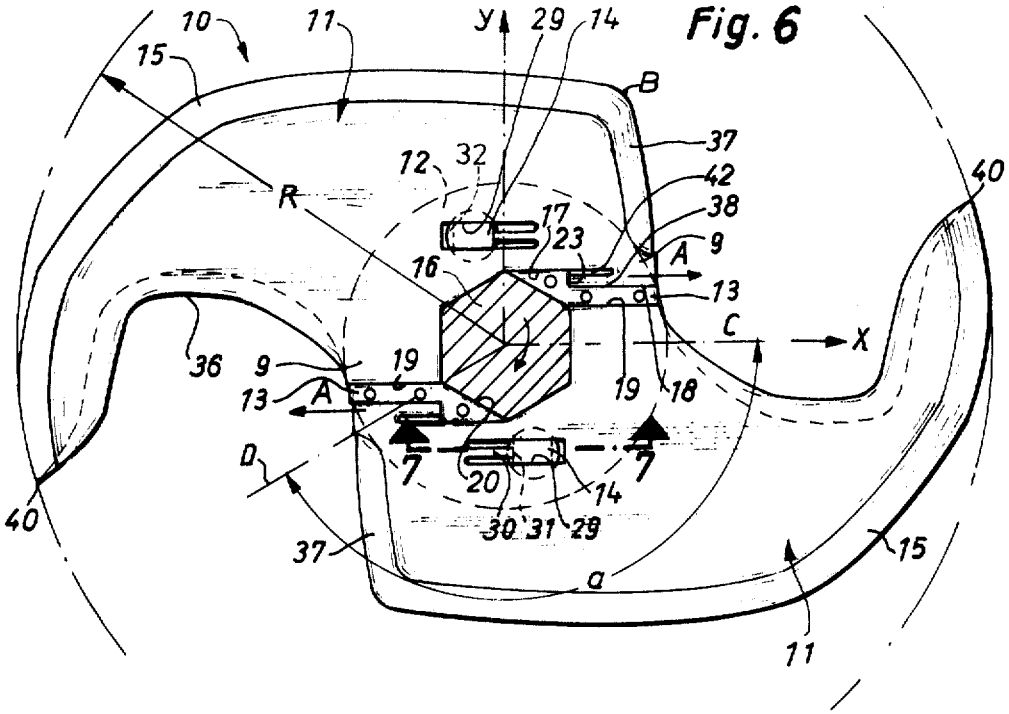
FIG. 6 is a plan view according to FIGS. 1 and 5, but of a fourth embodiment.

The blade groups 10 represented in FIGS. 1, 5 and 6 each consist of two identical plane blades 11, the flange heads 9 of which are guided in a straight line on a round disk 12 by means of two bars 13 and two pins 14 in such a way that the blades can be continuously displaced outwards in the direction of arrow A, that it, in diametrically opposite directions, for adjustment purposes, by grinding down the relevant bar or bars. This type of adjustment is always necessary when the blade cutting surfaces 15 have become worn. In addition, this also facilitates engagement and displacement of the individual blade groups disposed in series in the axial direction, the individual blades being of identical size such that the circles of rotation of the individual blades can be varied and can be adapted to the keys of the meat cutter which are curved on their bottom side.

The disk 12, which is shown, is form-lockingly disposed on a hexagonal shaft 16 which may be constructed in a manner known per se and thus does not need to be described in detail. It is necessary to point out that on one side of the disk and blade arrangement it possesses a thread and on the other side a flange such that the blade and disk arrangement can be pressed onto the flange of the shaft by means of a nut screwed onto the shaft thread, possibly interposing a covering disk. This enables the blades to be gripped between the disks.

In the embodiments represented in FIGS. 1, 5 and 6, each blade 11 comprises a single opening 29 for a round pin 14 which is formed on the disk 12 or which is disposed in a form-locking, rigid manner in the disk 12. Owing to this single opening which is designed to allow adjustment of the blade, the blade flange head is only minimally weakened. At the blade, the pin 14 possesses a cross-sectional profile which is obtained as a result of its original circular cross-section having been ground flat on the two opposite parallel sides. These ground guide surfaces of the pin 14 are disposed opposite the longitudinal sides of the opening 29 with friction bearing play. The opening 29 in each blade 11 has a U-shaped cross-sectional profile, the relatively narrow strip-shaped region 30 of the flange head 9 internally limiting the arms of the "U" engaging in a groove 31 extending at right angles to the longitudinal sides of the opening 29 and resting against the base of the groove 31. The side of the pin 14 facing away from the groove 31 is at least as far from the edge of the opening 29 as the groove 31 is deep, the mean distance between this edge of the opening 29 and the front face of the strip-shaped region 30 corresponding to at least the diameter of the pin 14. Each blade 11 which is placed on the disk 12 is engaged by a pushing movement at right angles to the axis of the disk in the groove 31 of the pin 14, such that a movement of the blade 11 in the axial direction of the disk also results in the disk 12 being displaced in this direction. The pin 14 comprises a second groove 32 parallel to the groove 31 and opposite thereto. This second groove is constructed in the same manner as the first groove 31. The grooves 31 and 32 are especially important for supporting the blades during displacement of the individual disks with a blade group and for assembly or mounting thereof. While the downwardly directed blade 11 with its tip, which is not represented in FIG. 1, is engaged by its region 30 in the groove 31, the blade 11 with its upwardly directed tip engages in the groove 32 by the force of gravity.

In this way, not only is the assembly operation facilitated and rendered less dangerous but by engaging the blades which generally consist of at least two blades, on the pins, and thus on the disk, the blades can simultaneously be used as a handle or lever which enables the disks to be removed more easily from the shaft during dismantling. In the past, considerable difficulties have often arisen when removing the disks from the shaft. The pins may also possess a rectangular cross-section.

Figure 8:
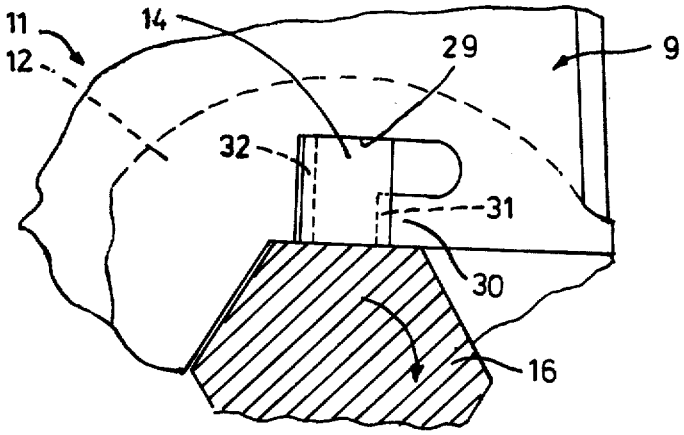
FIG. 8 is a variant of another part of FIG. 1.

In the variant represented in FIG. 8 which only comprises one blade 11, the rectangular pins 14 extend as far as the multi-sided inner recess of the disk 12, the groove 32 extending over the entire width and the groove 31 over part of the width of the pin 14 to which the bar 30 of the blade flange head 9 is adjacent. In conformity with the construction of the pins, the opening 29 in the flange head 9 is open on its narrow side.

Figure 7:
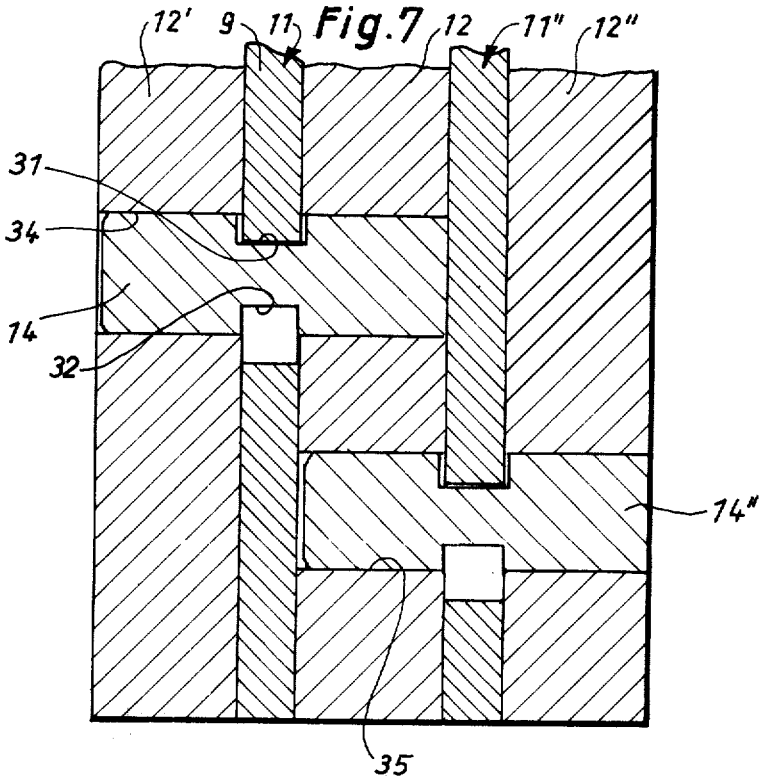
FIG. 7 is a partial section through the embodiment according to FIG. 6 on an enlarged scale along the line 7—7 and showing the preceding and following disks in the axial direction with their respective blade groups.

As is apparent from FIG. 7, the pins 14 project beyond the flange heads 9 and penetrate a recess 34 extending over the entire thickness of the adjacent disk 12', the shape of the recess 34 corresponding to the shape of the pin 14. In this way, the pins 14 are retained in a form-locking manner in the adjacent disk 12' and are preferably inserted into the recess 34 in a slide-fitting manner. The recesses 34 have the same cross-sectional shape as the pins 14. The length of the pins 14 is such that they practically pass completely through the adjacent disk 12 or are only terminated on its other front face, against which is disposed the adjacent blade 11'. As is also apparent from FIG. 7, the disk 12' comprises a recess 35 in which a pin 14'' of a disk 12'' is held in a form-locking manner. The recesses 34 and 35 are identical and are angularly displaced in four blade groups 10 comprising two blades 11 which are displaced about 60°. Part of the shock load acting on the blades via the pins is thereby not only transmitted to the associated disk but is transmitted in a uniform manner to the adjacent disk. As a result, it is impossible to subject the blade arrangement according to the invention to higher loads as the load is transmitted to the shaft in a uniform manner at various points and all the disks which are arranged in series in the axial direction are rigidly connected together by the pins which are retained therein in a form-locking manner.

In the embodiment according to FIG. 1, each blade 11 possesses three parallel, straight outer edges 17, 18, and 19 on its flange head 9. These outer edges are located on the same narrow side of the blade, this narrow side being the one facing the flange head of the adjacent blade. The outer edges 17, 18 and 19 are advantageously disposed as represented in FIG. 1. The parallel outer edges 17 and 18, which are offset with respect to each other, are adjacent to the inner edge of the blade while the outer edge 19 is adjacent to the rear end 37 of the cutting edge 16 and in the embodiment represented is flush with a plane fact 20 of the multi-sided shaft 16.

The outer edge 17 adjoins the inner bladeedge 36 and is guided on a relatively short guide surface 21 of a pin 22 of the bar 13 which projects beyong the flange 9 in an axial direction in a form-locking manner in a recess of an adjacent disk. The outer edge 18 adjoins at right angles an abutment edge 23 of the flange head 9 which is directed at right angles to the guided outer edge 17. The two blades 11 in a blade group 10 are disposed on the disk 12 in such a way that there is a gap 24 of, for example, 1/10 mm in width between the outer edge 19 of the one blade 11 and the outer edge 18 of the other blade 11 in a particular blade group 10, or of the surface of the bar 13 which is flush with this outer edge 18 and which faces away from the guide fact 21. In this way each blade 11 is only guided on its guide faces intended for this purpose. The gap 24 between the blades 11 in a particular blade group should be so small that practically no small pieces of meat can be deposited therein.

Each bar 13 is disposed in a form-locking manner in a groove of the disk 12 which is arranged in the direction of alignment, and the part 26 of the bar 13 which is inserted in the groove in the disk can be rigidly connected to the disk 12, for example, by means of a slide-fitting arrangement or by means of adhesive. The outer edge of the part 26 of the bar 13 which is inserted in the groove is flush with the adjacent circumferential surface of the disk 12. The pin 22 is integral with the end region of the part 26 of the bar 13 adjacent to the circumference of the disk 12. The outer face of the pin 22 is also flush with the circumferential surface of the disk.

A second part 27 integral with the end of the part 26 of the bar 13 adjacent to the shaft 15 projects downwards at right angles from the end of the part 26. This part 27 engages in a form-locking manner in a hole 28 passing through the disk 12 and the bar 13 is thus very firmly anchored in the disk. In this way, the bard 13 are always held firm in the disk 12 during operation of the meat cutter even when they are subject to powerful centrifugal forces.

Figure 2A:
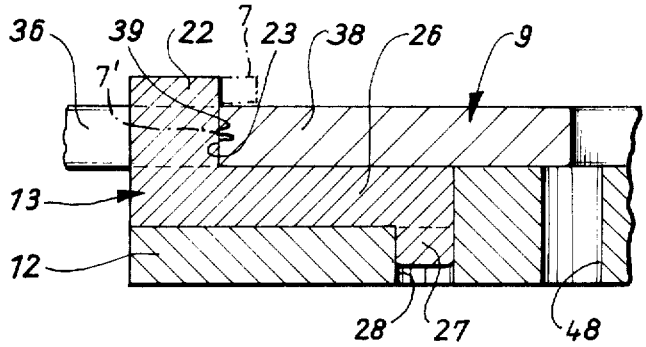
FIG. 2*a* is a partial sectional view through the embodiment according to FIG. 1 on an enlarged scale along the line 2—2.

According to the first embodiment represented in FIGS. 1 and 2*a*, each abutment edge 23 of the blade flange head 9 is provided at the free end of an arm 38 which is integral with the flange head 9. The free front end of the arm 38 which forms the abutment edge 23 is adjacent to, or very close to an abutment face 39 of the pin 22 of the re relevant bar 13, such that the abutment fact 39 always supports or at least, under unfavorable circumstances, assists the relevant blade against the centrifugal forces acting thereon.

The guided outer edge 17 and the arm inner edge 41 which merge into one another in a semi-circular fashion limit a slit 42. The outer edge of the arm 38 is flush with the outer edge 18 of the flange head 9. The abutment fact 39 is disposed at right angles to the guide edges 17 and 18—which is particularly advantageous.

Figure 2B:
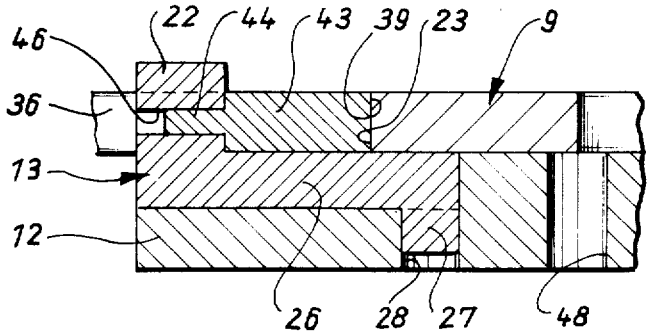
FIG. 2*b* is a partial section according to FIG. 2*a*, but of a second embodiment.

In the second embodiment represented in FIG. 2b each abutment edge 23 of the blade flange head 9 is formed by a narrow side surface connecting the two straight outer edges 17, 18, and extending at right angles to the same, thur eliminating the slit 42 provided in the flange head 9 in FIG. 1, in a manner not represented. The rectangular abutment face 39 which is used to support the abutment edge 23 of the flange head 9 is formed, in this embodiment, by the front end of a plug-in part 43 facing towards the shaft 16. Outside of the pin 22, this plug-in element 43 has a rectangular cross-section and its other pin-type end 44 which preferably has a circular cross-section is inserted in a form-locking and releasable manner in a complementary recess 46 in the pin 22 of the bar 13. The bar 13 thus has exactly the same form in this second embodiment as in the first embodiment with the exception that a recess 46 is provided in the pins 22 for the plug-in part 43. To adjust the blades, the associated plug-inparts 43 are ground down on the surfaces 39 in the same way as the bars 30 (FIG. 1). As the plug-in parts 43 can be readily removed from the bars 13 and disks 12, the grinding down of these parts presents no problem. In the embodiment shown in FIG. 1, to adjust the blades, the bars 30 and also the bars 38 are ground down by the requisite amount.

In many cases it is advantageous if the abutment face 39 does not possess a plane surface, but is graduated as represented in a variant in FIG. 4, such that the abutment surface 39 of the arm 38 is adjacent to the staggered part which is displaced with respect to the edge of the disk.

It is also advantageous for the bar 13 or the removable plug-in part 43 to be constructed in such a way that the abutment fact 39 is the base of a groove which is provided in the relevant bar 13 or plug-in part 43 or which is formed by a recess in the bar 22 or the plug-in part 43 and the adjacent upper surface of the disk. This groove results in that the relevant plug-in part 43 or the bar 13 and the pin 14 overlap the particular blade flange head and thus improve the attachment of the blades to the disk before the disks are braced together. An embodiment is represented by the perforated lines in FIG. 2a, wherein the extention 7 of the pin 22 of the bar 13 located on the upper side of the blade flange head 9 and represented by the perforated lines overlaps the blade flange head, such that the abutment face is formed by the base of a groove 7'.

Figure 3:
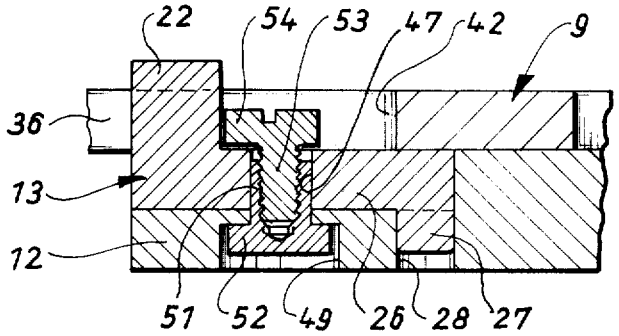
FIG. 3 is a partial sectional view on an enlarged scale through the embodiment according to FIG. 1 along the line 3—3.

Two bore holes 47 and 48 are provided in the disk 12 for each blade 11 in a blade group 10. These bore holes 47 and 48 pass through the disk 12 and possess an enlargement 49 on their ends facing away from the associated blade flange heads 9 and facing towards an adjacent blade group. The bore hole 47 is disposed in a region of the disk 12 which is left free by the slit 42 when the appropriate new blade 11 is inserted. On the other hand, the bore hole 48 is disposed close to the opening in the disk 12 provided for the shaft 16 and when a new blade is inserted, it is partially or totally covered by the blade flange head (FIGS. **2*a*, 2*b*). Screwed stop pins 51 are designed to be inserted in a form-locking manner in the bore holes 47, 48, the heads 52 of these pins being sunk in the enlargement 49. Pins of this type are inserted in either the bore holes 47 or the bore holes 48. Each pin 51 is provided with an inner thread in which a screw 43 may be inserted, the head 54 of which is eccentrically disposed with respect to the axis of the thread part of the groove 53, as represented in FIG. 3. When the blades 11 are new, screwed stop pins are only screwed into the bores 47 and, before the blades are applied, the screws 53 are loosely screwed therein. The bore 47 is disposed in such a way that after the relevant blade 11 is inserted, the head 54 can be turned until it presses against the inner arm edge 41, thus pressing both the outer edge 17 aainst the guide face 21 of the bar 13 and also the one longitudinal side of recess 29 of the flange head 9 against the pin 14. Each blade 11 is braced on the disk in this way and secured so that it can be carried and/or the disk with the blades secured thereon can be mounted without the blades being displaced relative to the disk 12. If the blades 11 in a particular group 10 have already been ground down to such an extent and adjusted so that the arched base of each slit 42 very nearly presses against the screw head 54 and could prevent it from being turned, the screwed stop pins 41 and their associated screws 53 are transposed in the bores 48 which are freed by adjustment of the blades 11 and the eccentric heads 54 now press against the edges of the blades disposed at a distance from the shaft 16 and brace these between them and the abutment surfaces 39 so that they are also held fast on the disk. The grooves 31 of the pins 14 also help keep the blades firm on the disk 12 before they are combined with the other disks as they prevent axial displacement of the blades when the screws 53** are tightened.

Securing screws 51, 53, of this type can obviously also be provided in the embodiment according to FIG. 2b and the blades can also be designed in such a way that even with new blades the screw heads 54 press against the narrow sides of the blade flange heads 9 disposed opposite the shaft 16.

The embodiment represented in FIG. 5 differs from the embodiment according to FIG. 1 in the construction and arrangement of the bars 13 and of the straight outer edges on the flange head 9 of each blade 11, which, in this case, possesses two parallel straight outer edges 17, 19, which are offset with respect to each other and guided on the bars 13 provided with parallel guide surfaces and extending from the inner edge to the outer edge of the disk 12, the guided outer edges 17, 19, thus also extending from the shaft 16 to the edge of the disk 12. The bars 13 thus possess no abutment faces and the pins 14 do not possess grooves so that the strip-from region 30 is disposed directly adjacent to the outer edge of the particular pin 14.

The embodiment represented in FIG. 6 differs from the embodiment shown in FIG. 5 in that the flange heads 9 again have a ledge forming a transverse abutment edge 23 which carries over the outer edge 17 to a second outer edge 18 disposed parallel to the edge 17 and ending in the rear region 37. Between the end of the first outer edge 17, which, in this case as in the case of the outer edge 19 is not flush with a plane face 20 of the shaft 16 and the abutment edge 23 extending at right angles to the outer edges 17 and 18, a slit 42 is provided in the flange head 9, this slit being very narrow, extending parallel to the second outer edge 18 and being about half as long as the same. In this case, the slit 42 limits with the second outer edge 18 a stri-form region 38 which is relatively narrow and the frong face of which forms the transverse abutment edge 23. The bars 13 are constructed in a similar manner, their edges facing the inner hexagonal edge of the disk 12 being flush with a plane side face 20 of the inner hexagon.

The bars 13 of the embodiment shown in FIGS. 5 and 6 advantageously also project in the manner of the pins 22 beyond the flange heads 9 of the plane blades 11 and engage in a form-locking manner in a recess of an adjacent disk.

If a plurality of disks 12, each comprising a blade group 10, are disposed in series in an axial direction, disks 12 comprising bars 13 and a blade group 10 can be disposed both according to the embodiments represented in FIGS. 1 and 6. The advantage of this is that the individual blade groups 10 which disposed in series can be displaced with respect to each other about an angle which is less than the partial angle of a hexagonal section of 60°. It is also possible to provide more blade groups 10 than the number of edges on the multi-sided shaft 16, all the blade groups 10 being angularly displaced with respect to each other and none of the blades 11 being flush with each other in the axial direction.

Figure 9:
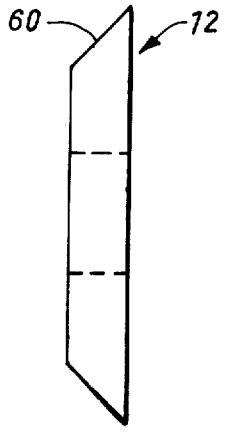
FIG. 9 is a side view of a disk according to a fifth embodiment.

According to another embodiment represented in FIG. 9, when a plurality of disks are arranged in series in the axial direction, the first leading disk 12 in the direction of movement of the meat, and thus in the axial direction, may be conical, with its diameter increasing in the direction of movement of the meat. Its front fact which faces away from the cone 60 and is adjacent to the flange heads 9 of a blade group 10 remains unchanged—which is important for good support. The cone 60 of the leading disk 12 in a blade arrangement produces a wider passage between the disk and the key of the meat cutter at the counterblades, thus reducing the likelihood of the meat being jammed. Accordingly, the meat reaches the counterblades more easily and is drawn in more readily, that is, it passes to the following group of blades more rapidly which improves the cutting process. As jamming of the meat decreases, the meat cutter is cooled more readily as, when increased jamming occurs, there is also a greater quantity of meat in front of the blades, preventing the arrangement from cooling down.

Numerous variants of the invention are permissible. For example, instead of a hexagonal shaft, a shaft having a different outer profile—other than a circular profile can be provided, for example, a groove and tongue profile. The features described in the specification can also be provided individually for each blade. The blade arrangement according to the invention also permits the use of disks having an extremely small diameter. This reduces the weight of the disks and thus of the device as a whole and thus facilitates travel through the meat.

What is claimed is:

1. A blade arrangement for meat cutters comprising a driven shaft on which form-locking disks are disposed adjacent to each other, a blade group, preferably comprising two identical blades being disposed between adjacent disks, and the disks being braced together in the axial direction of the shaft and the flange head of each blade being guided in a radial direction on fixed guide surfaces on at least one of the adjacent disks, characterized in that the edges of the flange heads of each blade of at least one blade group which are guided by the guide surfaces consist of one or more outer edges of the flange head and one or more straight edge regions of at least one opening in the flange head and in that the guide means for the outer edge in question or the particular outer edges of the flange head is formed by at least one bar projecting beyond an adjacent disk and the guide means for the straight edge region or regions of the opening consists of at least one pin engaging in the opening.

2. A blade arrangement as claimed in claim 1, wherein the pin forms an abutment for the blade flange head which limits displacement of the blade in the outward guide direction.

3. A blade arrangement as claimed in claim 1, wherein the pins project beyond the flange heads of the blades of the relevant blade group and engage in a form-locking manner in recesses of the adjacent disk.

4. A blade arrangement as claimed in claim 1 wherein the opening in the flange head has a U-shaped mean cross-section, the strip-form region of the flange head limiting the arms of this U on the inner side being designed to abut against the pin.

5. A blade arrangement as claimed in claim 1, characterized in that the pin comprises at least one retaining cam for the associated blade and preferably two retaining cams disposed on opposite sides of the pin.

6. A blade arrangement as claimed in claim 5, wherein the pin comprises a groove in which a strip-shaped region of the blade flange head engages with slight play and rests against the base of the groove, the strip-form region being limited by a U-shaped mean cross-section of the opening in the flange head.

7. A blade arrangement as claimed in claim 1 wherein a stop is provided for the blade flange head on a guide bar or the bar itself forms a stop such that the abutment limits the displacement of the blade in the outward guide direction.

8. A blade arrangement as claimed in claim 1, wherein the flange head of the blade comprises on its end adjacent to the inner blade edge, an outer edge guided on a bar.

9. A blade arrangement as claimed in claim 1, wherein the flange head of the blade comprises on its end adjacent to the inner blade edge an abutment extending at right angles to the direction of alignment, this abutment edge facing away from the driven shaft and being arranged immediately opposite or a slight distance from an abutment surface facing towards the shaft, this abutment face being immobile relative to the disk, at least in an outward direction.

10. A blade arrangement as claimed in claim 9, wherein the abutment edge of the blade flange head is the front edge of an arm of the blade flange head extending generally parallel to the guided outer edge, a slit bordering the inner edge of the arm.

11. A blade arrangement as claimed in claim 9, wherein the abutment face consists of a face of the bar.

12. A blade arrangement as claimed in claim 9, wherein the spacing between the abutment face and the adjacent circumferential region of the disk is smaller than the spacing from the driven shaft.

13. A blade arrangement as claimed in claim 9, wherein the abutment face is a face of a plug-in part which is inserted into the bar in a form-locking, releasable manner.

14. A blade arrangement as claimed in claim 1, wherein clamping means are provided on the disk, these clamping means pressing the blade flange heads against alignment faces and/or abutment faces by the action of forces acting in the blade plane, to clamp the blades on the disk, for transport or assembly purposes.

15. A blade arrangement as claimed in claim 14, wherein each clamping means consists of a screwed stop pin and a screw which is screwed into the same, one of the screw heads being non-round or eccentric to the screw axis and the screwed stop pin being inserted in a form-locking manner in the continuous bore hole in the disk.

16. A blade arrangement as claimed in claim 14, wherein at least two bore holes receiving the screwed stop pin in an alternate manner are provided in the disk for each blade, one of these bore holes being disposed in a part of the disk which, in the case of new blades, in not yet covered by the flange head of the blade and at least another bore hole being disposed in such a way that the flange head of a new blade covers it at least partially, but it is no longer covered by the blade flange head afterrepeated grinding of the blade.

17. A blade arrangement as claimed in claim 1, wherein the leading disk in the direction of movement of the meat increases its diameter in this direction of movement, preferably in a conical manner.

* * * * *